United States Patent [19]

Bucalo

[11] Patent Number: 4,783,109

[45] Date of Patent: Nov. 8, 1988

[54] CRITICAL CARE EQUIPMENT TRANSPORT SYSTEM FOR AN AMBULANCE STRETCHER

[76] Inventor: Frank J. Bucalo, 8545 SW. 58th St., Miami, Fla. 33143

[21] Appl. No.: 80,263

[22] Filed: Jul. 31, 1987

[51] Int. Cl.[4] ..... A61G 1/02

[52] U.S. Cl. ..... 296/20; 5/507; 248/122

[58] Field of Search ..... 296/200; 248/122, 121, 248/127, 146; 5/503, 5/508, 507; 128/1 R, 1 D

[56] References Cited

U.S. PATENT DOCUMENTS

| | | | |
|---|---|---|---|
| 3,820,838 | 6/1974 | Limpach | 296/20 |
| 4,352,991 | 10/1982 | Kaufman | 296/20 |
| 4,584,989 | 4/1986 | Stith | 296/1 D |
| 4,691,397 | 9/1987 | Netzer | 5/507 |

*Primary Examiner*—Robert R. Song

*Attorney, Agent, or Firm*—Lowe, Price, LeBlanc, Becker & Shur

[57] ABSTRACT

A light tubular framework, attachable to a standard ambulance stretcher by known mechanical fittings, supports at least one shelf above a patient on the stretcher, to provide support for vital life support equipment that must accompany the patient as he or she is transported on the framework is structured to provide considerable bracing and secure mounting thereon of critical life support equipment, so that the stretcher may be safely moved over broken or uneven surfaces without dislodging the equipment. In one aspect of the invention, an aditional support surface is provided by readily detachable connection of a shelf-like element to the stretcher bracing crossbars adjacent its wheels to temporarily support heavy elements of equipment thereon. The height of the structure is selected such that, even with equipment mounted thereon, a stretcher improved by the addition of the invented apparatus can be readily loaded into or removed from a standard ambulance without any interference with parts threof by a single attendant.

18 Claims, 4 Drawing Sheets

CRITICAL CARE EQUIPMENT TRANSPORT SYSTEM FOR AN AMBULANCE STRETCHER

BACKGROUND OF THE INVENTION

1. Field of the Invention

This invention relates to apparatus for carrying critical care equipment needed by a patient being carried in a stretcher to, from or in an ambulance and, more particularly, to apparatus attachable by commonly available attachment mechanisms to a standard collapsible ambulance stretcher.

2. Background of the Invention

Injured persons (such as accident victims) or severely indisposed persons (such as stroke victims) often have to be rushed to a suitable medical facility, generally in a prone position, on a standard collapsible stretcher that can be lowered close to the ground or raised to a height convenient for pushing by an attendant and which readily collapses as it is pushed into an ambulance. There are many circumstances when such a patient must be provided vital substances, e.g., oxygen, saline solution, a mechanical ventilator or the like, or must have his or her vital functions monitored continuously during the trnsportation process so that the attendants may be continually informed of the patient's condition and may take remedial action promptly as needed. The supply of vital substances and the monitoring of vital body functions both generally require the use of substance containers or monitoring equipment that must be continually located very close to and connected to the patient during his or her rapid transportation from the scene of trauma, on the stretcher into the ambulance, during the ambulance ride and, subsequently, out of the ambulance and to the proper location in a suitable medical facility. Under most circumstances, time is of the essence and only one or two attendants are available to serve the patient's needs during this entire transportation process. Clearly, such one or two attendants, especially if one of them also functions as the ambulance driver, cannot possibly carry all the necessary equipment and attend to the patient's needs simultaneously or efficiently.

A need therefore exists for apparatus that will provide a system for supporting critical care equipment on an ambulance stretcher, such that transferral of a patient onto or from the stretcher, as well as access by the attendants to the patient lying on the stretcher, is not seriously impeded. Such a system should be of a size and geometry such that it can comfortably and securely carry the weight of all necessary critical care equipment in convenient juxtaposition to the patient on the stretcher; allow electrical interconnection with power sources on the ground, in the ambulance, and at the medical facility; prevent unacceptable bouncing of the equipment during rolling of the stretcher on relatively uneven streets or sidewalks; not add significantly to the weight of the stretcher; and, preferably, be attachable to existing standard ambulance stretchers for retrofitting and improvement thereof.

DISCLOSURE OF THE INVENTION

Accordingly, it is an object of this invention to provide a system for holding critical care equipment by easy attachment with known attachment mechanisms onto a standard ambulance stretcher.

It is another object of this invention to provide a critical care support system for attachment to a standard ambulance stretcher that supports a variety of critical care support equipment securely against extraneous forces, e.g., as may be encountered while the stretcher is being pushed along uneven pavement, during transportation of a patient.

A further object of this invention is to provide a critical care equipment support system, readily attachable to a standard ambulance stretcher, that is shaped and sized so as to permit the stretcher and the system to be readily loaded into or unloaded from a standard ambulance by a single attendant.

It is a related further object of this invention to provide a critical care support system, readily attachable to a standard ambulance stretcher, that enables the location of heavy elements of the critical care support equipment such that the stretcher, with a patient and all the equipment on it, has a low enough center of gravity to ensure stability during its motion over relatively uneven surfaces, e.g., cracked or broken pavement or curbs.

These and other related objects of the invention are realized in a preferred embodiment of the invention by providing a framework, including first and second pairs of support legs and one bracing leg, each of the support legs and bracing leg having a vertical portion with a lower end attachable by known fittings to a portion of the stretcher and each having an inclined portion with an upper end attached to a first equipment support rack. The lower ends of the first and second pairs of support legs are positioned adjacent the normal location of the feet of the patient lying on the stretcher, and the upper ends of each of both pairs of support legs are located forwardly thereof, with the lower end of the bracing leg being attached to the stretcher closest to the head of the patient on that side of the stretcher which is opposite the side from which the patient is normally transferred to or from the stretcher. In another aspect of the invention, a lower snap-fitted shelf is detachably supported on the stretcher frame bracing close to the stretcher wheels to temporarily support heavy items. In yet another aspect of the invention, one or more additional equipment support racks are provided above and/or below the first equipment support rack.

Still other objects and advantages of the present invention will become readily apparent to those skilled in the art from the following detailed description, wherein only the preferred embodiment of this invention is disclosed in detail simply by way of illustration of the best mode contemplated for carrying out the invention. As will be appreciated, this invention is amenable to other and different embodiments, and its several details are capable of modification in various obvious respects, all without departing from the invention. Accordingly, the drawing and description are to be regarded as illustrative and not restrictive in nature.

DETAILED DESCRIPTION OF THE PREFERRED EMBODIMENT

Figure 1:
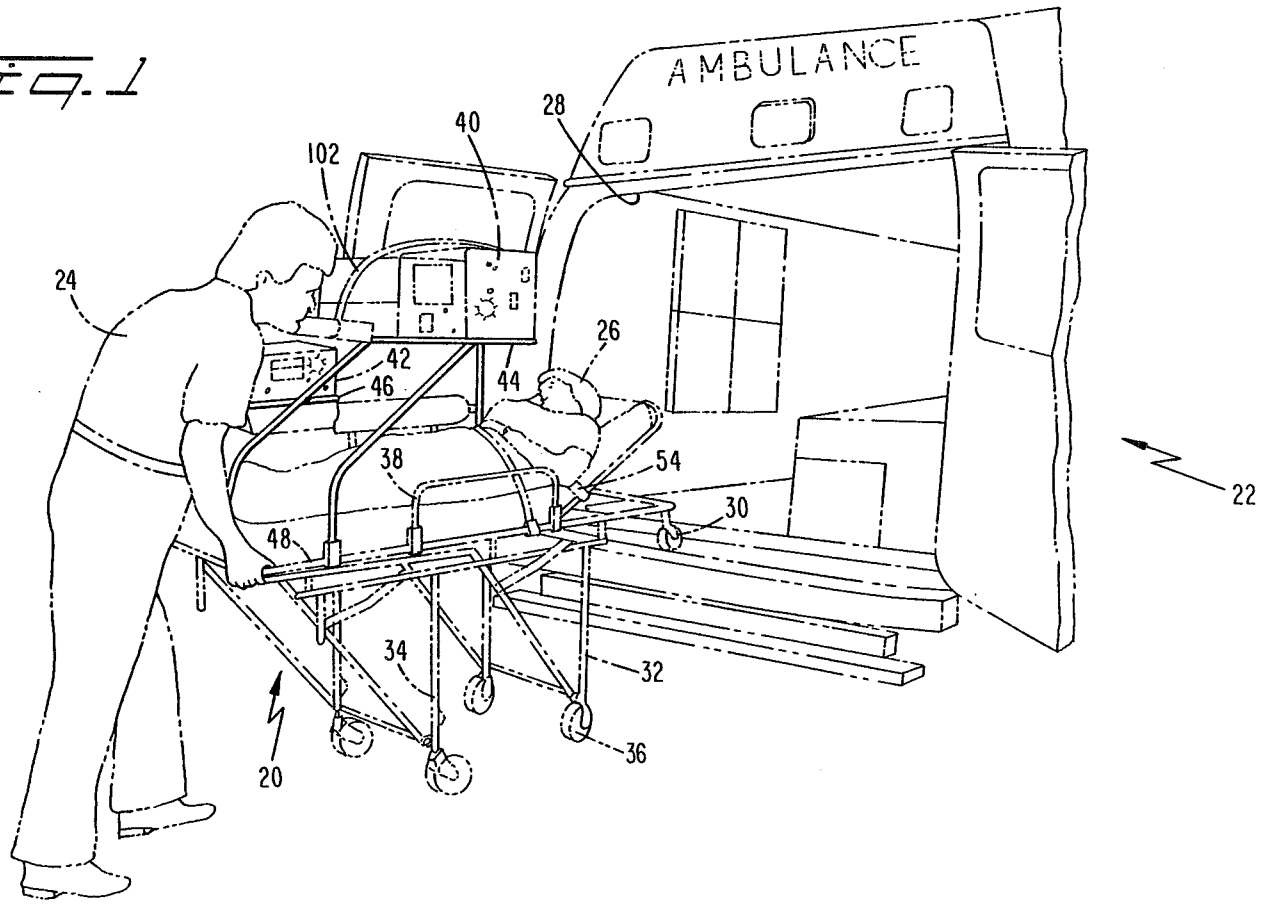
FIG. 1 is a perspective view illustrating how a single attachment may manipulate a stretcher carrying a patient and the critical care support system according to a preferred embodiment of this invention onto or out of an ambulance.
Figure 2:
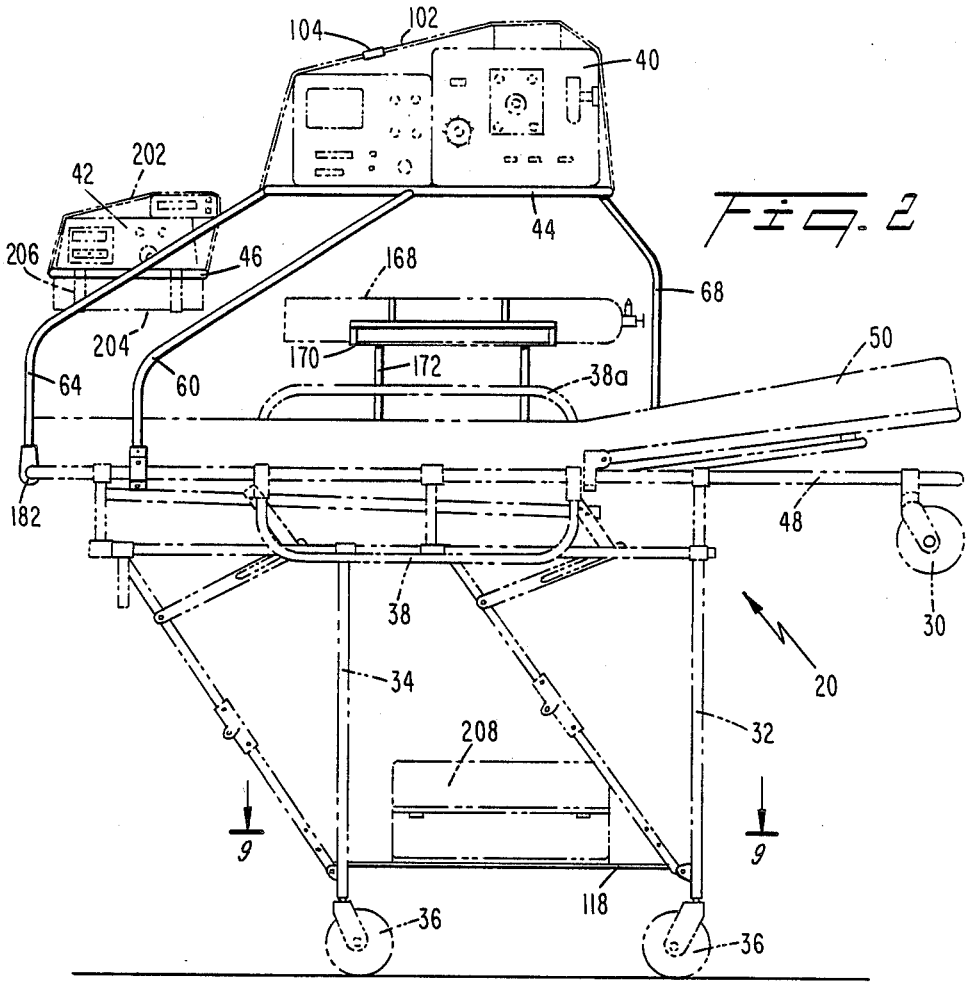
FIG. 2 is a side elevation view from a patient-loading side of the ambulance of FIG. 1, without the patient and attendant, according to a preferred embodiment of this invention.

The apparatus of this invention, as best seen in FIGS. 1 and 2, according to a preferred embodiment more fully described hereinbelow, involves a generally tubular structure with the principal portion thereof mounted above and to a peripheral tubing framework 48 of a standard ambulance stretcher 20. Its principal purpose is to support assorted pieces of equipment such as 40, 42 and 208, best seen in FIG. 2, at locations permitting the immediate and effective use of the equipment while leaving sufficient room to permit the easy transfer of a patient to or from the stretcher, even when the patient's torso is lifted somewhat to suit his or her particular needs of the moment.

In one aspect of the invention, a principal portion of the apparatus is located generally above the patient and a smaller tray-like portion 118 is located between the stretcher wheels and below the patient, to support items temporarily placed thereon and to lower the center of gravity of the combined mass of the critical care support equipment, the framework, the stretcher, and the patient.

Figure 4:
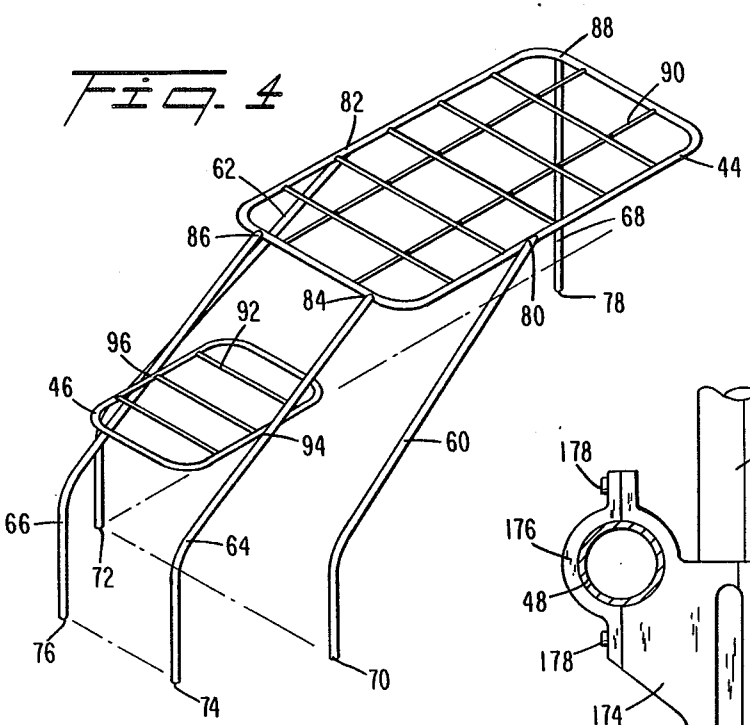
FIG. 4 is a perspective view of the principal portion of the preferred embodiment of this invention not attached to a stretcher.

Referring now to FIG. 4, in a preferred embodiment of the invention, a principal portion of the apparatus has the form of a tubular assembly comprises of five legs 60, 62, 64, 66 and 68. Of these, legs 60 and 62 form one similar pair and legs 64 and 66 form a second similar pair, with both pairs being disposed symmetrically about the longitudinal axis of the stretcher's tubular frame 48. These legs 60, 62, 64, 66 and 68 respectively have bottom ends 70, 72, 74, 76 and 78 to vertical segments of each.

The top ends of these five legs are attached to a generally rectangular top rack or shelf frame 44 at upper ends 80, 82, 84, 86 and 88, respectively, as best seen in FIG. 4. The attachment of the various legs to top shelf frame 44 may be obtained in any known matter, e.g., by means of welding or brazing, via detachable fittings, or by bolting or screwing together of the same, the exact choice of method for making the attachment being dictated by considerations of weight, cost, convenience and esthetic appeal.

Rack 44 preferably will support a flat upper shelf 98 and will carry relatively heavy and large elements of critical care equipment and may be provided with a set of crisscrossing set of bracing bars 90. As best seen in FIG. 4, top rack 44 is thus supported at five locations, i.e., at the top ends of the five legs. At a level somewhat lower than that of the top rack 44 is provided a lower rack or shelf frame 46 attached to the rearmost two legs 64 and 66 at locations 94 and 96. Lower rack 46 may be provided with reinforcing crossbars 92. The precise location of lower rack 46 with respect to the lowermost ends of the legs and upper rack 44 is a matter of convenience.

Although any suitable tubular or rod-like structural elements may be used to form the described structure, for ease of cleaning and sterilization it is preferred that the structure be formed of stainless steel tubing, with all joints welded and smoothed out to avoid any residual sharp edges. Other materials, such as aluminum tubing, fiberglass reinforced rods, and the like, may also be utilized and may be preferable depending on circumstances.

Figure 5:
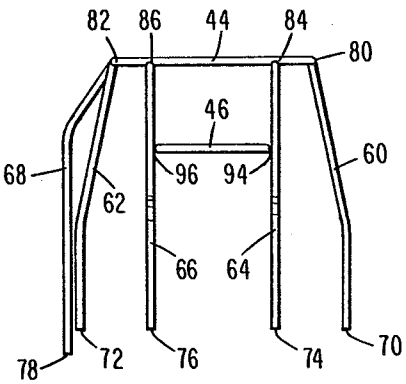
FIG. 5 is an end elevation view of the apparatus of FIG. 4, as viewed from the foot end of a stretcher to which the same would be attached.

As best seen in the end vertical elevation view of FIG. 5, the lowermost ends 70, 72, 74 and 76 of the end legs preferably end at the same level, i.e., in a plane substantially parallel to the planes defined by the tubular frames 44 and 46 of the top and lower shelves. Because there is only one leg 68 close to the patient's shoulder, it may be preferable to hold lower end 78 thereof outwardly of the stretcher frame 48 in a somewhat different kind of fitting than that used for the other legs. For this reason, the vertically downward portion ending at end 78 of leg 68 may be made somewhat longer than for the other legs.

Figure 6:
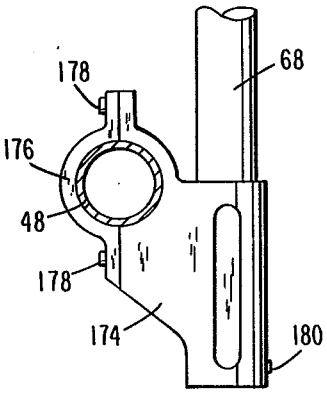
FIG. 6 is an elevation view of a standard stretcher fitting of the type that may be employed to attach a vertical portion of the apparatus of the preferred embodiment of this invention to a standard stretcher.

The actual fitting of the leg ends to generally rectangular tubular frame 48 of stretcher 20 is best accomplished by the use of a standard fitting of known type commercially available for this purpose. One type of fitting that may be particularly suitable for affixing the end of leg 68 (which does not have a symmetrically disposed counterpart on the patient-loading side of stretcher 20) is shown in FIG. 6. The fitting has a main body 174 with a vertical aperture (not shown) for receiving therein of the lower end 78 of leg 68. A pin 180 may be driven laterally through the lowermost portion of leg 68 to prevent rotation of body 174 around leg 68 when the apparatus is removed, e.g., for cleaning or otherwise. Body 174 cooperates with a clamping element 176 affixed thereto by two bolts 178. Clamping element 176 is formed to have a shape and size such that fastening of bolts 178 will cause a portion of tubular stretcher frame 48 to be tightly clamped between clamping element 176 and a generally semicylindrical portion formed in body 174.

Figure 3:
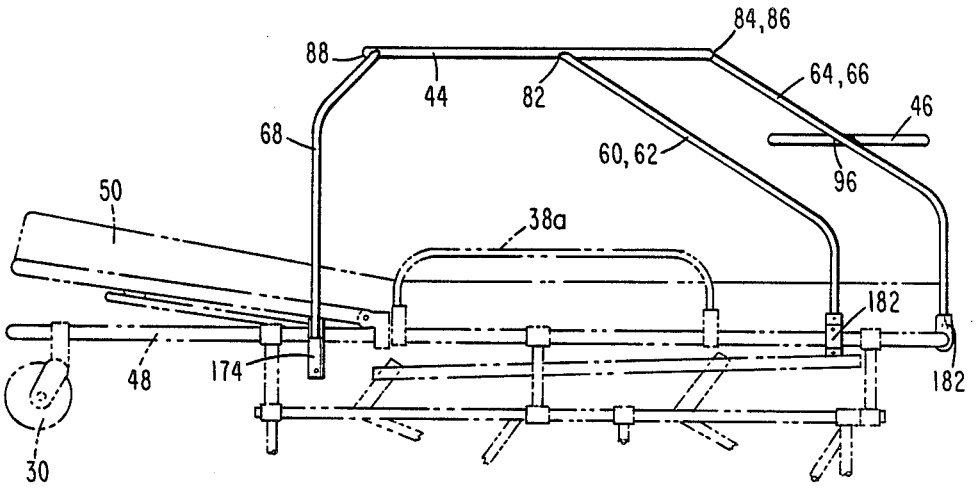
FIG. 3 is a side elevation view of the principal elements of the critical care support system, according to a preferred embodiment of this invention, on the opposite side from which the patient would normally be loaded onto the stretcher.
Figure 7B:
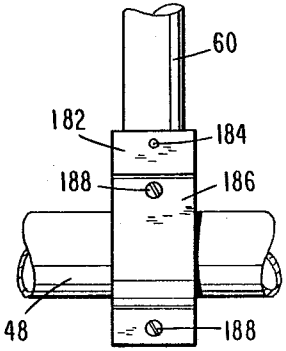
FIGS. 7A and 7B are end and side elevation views, respectively, of an alternative standard fitting for attaching portions of the apparatus according to a preferred embodiment of this invention to a standard stretcher.
Figure 7A:
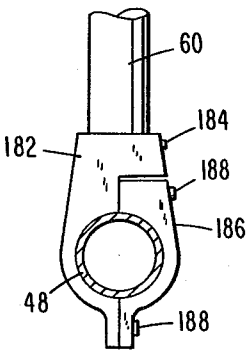

An alternative form of a commonly available fitting is illustrated in FIGS. 7A and 7B. This fitting consists of a body 182 cooperating with a clamping element 186 affixed thereto and tightened into place by bolts 188 to clamp around a portion of tubular frame 48 of stretcher 20. A typical leg 60 is received in a generally cylindrical opening (not shown) therefor. A pin or small screw 184 is driven in laterally through an upper portion of body 182 and into a matchingly sized and located aperture (not shown) formed therefor in leg 60 adjacent the lowermost end 70 thereof. The general disposition of such an attachment element is seen in FIGS. 1, 2 and 3.

As persons skilled in the art will immediately appreciate, a large variety of such fittings is commercially available and may be used effectively for the purposes described hereinabove. Again, as with the tubular framework, considerations of cost, weight, convenience and esthetic appeal must be taken into account in selecting the fittings for the purposes just described.

Figure 8:
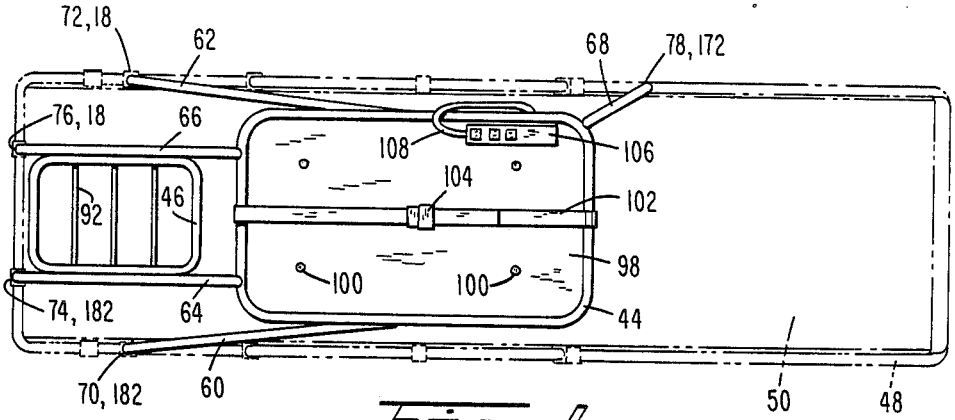
FIG. 8 is a plan view of the preferred embodiment of this invention mounted to a standard stretcher.

As a practical matter, in order to conveniently mount assorted pieces of equipment in the most efficient manner, a flat sheet-like shelf 98 may be provided to rest on bracing bars 90 on the upper rack 44. Such a sheet may be provided with a plurality of apertures 100, as best seen in FIG. 8, for positive location of various pieces of equipment. Rack 44 may be provided with an adjustable belt or strap 102 and an adjustable buckle 104 to firmly strap down various pieces of equipment, as best seen in FIG. 1. This would enable even a single attendant to quickly loosen the belt and remove individual pieces of equipment as appropriate.

Although not explicitly shown in FIG. 8, a similar flat sheet-like shelf may be provided of a shape and size that would fit to lower rack 44 and it too may be provided with a belt 202, as best seen in FIG. 2, for securely locating other pieces of critical care equipment 42 or the like thereon. Furthermore, other compact pieces of equipment, e.g., 204, may be strapped underneath either one of tubular frames 44 or 46 by straps such as 206 illustrated for the lower shelf in FIG. 2.

As best seen in FIG. 2, which is a side elevation view from the patient-loading side, the lower ends of legs 60, 62, 64 and 66 are located very close to the feet of the patient, with legs 64 and 66 being attached for the transverse end portion of stretcher tubular frame 48. This leaves the vast portion of the side of stretcher 20, i.e., the mattress or pad portion 50, easily accessible for the deposition thereon of the traumatized patient. In other words, the structure carrying the critical care equipment is virtually out of the way and does not interfere with transfer to or removal from the stretcher of a patient, or the access to all portions of the patient by the attendant as necessary. A rotatable or slidable element 38 on the patient-loading side may be moved from the downward position shown in FIG. 2 to the upward position shown in FIG. 1 therefor to facilitate retention of the patient in place on the stretcher. Furthermore, as best seen in FIG. 1, the patient-securing strap 54 may also be provided. On the far side, i.e., away from the patient-loading side, a similar rotatable or slidable patient-securing element **38*a*** may be provided and utilized.

For stretchers that are normally used for a particular kind of mission, e.g., to rescue burn victims, a gas cylinder 168 containing oxygen or the like may be mounted to a support frame 70 attached by vertical legs 172 to the rectangular tubular frame 48 of stretcher 20, preferably on the non-loading side of the stretcher.

Furthermore, because certain elements of the critical care equipment require electrical power, such power may be provided either by batteries made integral with the individual pieces of equipment, i.e., DC current may be provided to operate the same. However, when a long ambulance trip is contemplated and the ambulance itself can provide the electrical power, AC current may be utilized in known manner by plugging in the equipment to a multiple outlet element 106 connected by an electrical cable 108 to a plug (not shown) that may be coupled to a source of electrical power. This is best seen in FIG. 8.

Figure 9A:
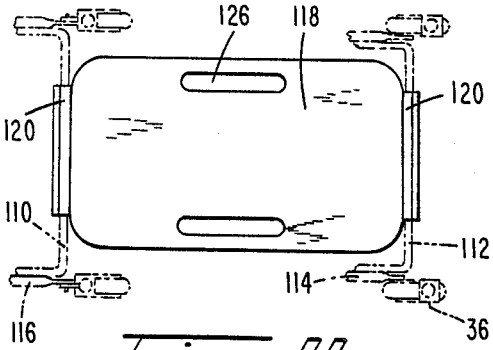
FIG. 9A is a plan view of the lower portion of the system according to a preferred embodiment of this invention, at Section 9—9 of FIG. 2.
Figure 9B:
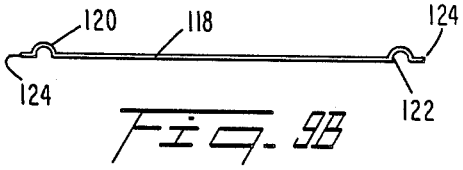
FIG. 9B is a longitudinal side elevation view of a tray element in the lower portion of the system according to a preferred embodiment of this invention.

Under certain circumstances, it may be highly desirable to temporarily transport additional rather heavy pieces of equipment, at least on a temporary basis, with the patient, e.g., packages of medication, doctors' bags and the like. In yet another embodiment of the present invention, and as an integral part thereof, yet another shelf arrangement is provided at the lowest convenient location of the stretcher. As best seen in FIGS. 2, 9A and 9B, this portion of the invented apparatus preferably has the form of a generally rectangular sheet-like tray element 118 preferably made of aluminum or stainless steel that has generally semicylindrical portions 120 at each end shaped and sized to snap-fit over bracing tubular members 110 and 112 of the stretcher very close to casters 36 thereof. This entire tray-like support element 118 is thus easily fitted on or removed from its grip on transverse tubular elements 110 and 112 as desired. Note, particularly with reference to FIG. 9A, that it does not interfere in any way with operation of the typical operated caster locking brakes 114 or 116 as are commonly found on ambulance stretchers. In principle, therefore, this tray-like element 118 may be temporarily snap-fitted into place and support thereon heavy pieces of equipment such as 208, best seen in FIG. 2.

When the stretcher 20 is to be loaded into an ambulance 22, as best seen in FIG. 1, the tray element 118 may be moved by the application of upward force to end lips 124 provided therefor. Persons skilled in the art will understand immediately that the application of an upward force on one of the lips 124 will tend to open out the semicylindrical portion 120, thereby releasing from gripping contact with the inner surface 122 thereof tubular members 110 and 112 that normally support the same. Tray element 118 may also be provided with suitably sized apertures 126 through which the attendant may pass his fingers to lift the same or, if necessary, an additional separate belt (not shown) may be passed to firmly and securely locate equipment placed thereon.

Persons skilled in the art will appreciate, particularly with reference to FIG. 1 hereof, that the exact dimensions, particularly the height of top shelf 44 with respect to tubular frame 48 of stretcher 20, must be selected with consideration given to the likely height of equipment 40 to be placed on shelf 44. The total height of the uppermost portions of equipment 40 must be low enough that top edge 28 of the ambulance entrance can be safely cleared as stretcher 20 is loaded on or unloaded from the ambulance.

Figure 10:
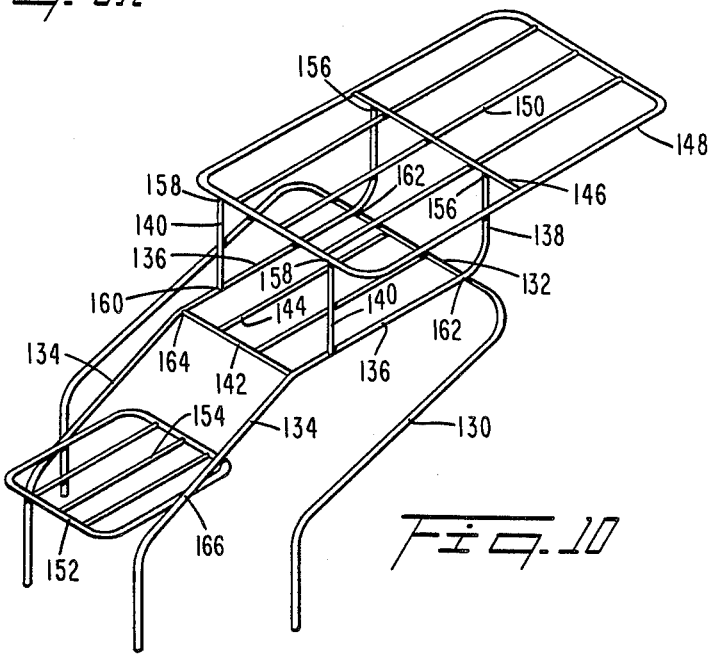
FIG. 10 is a perspective view of an alternative embodiment of a principal portion of the system according to another embodiment of this invention.

In principle, particularly with an ambulance that has sufficient clearance therefor, another preferred embodiment of this invention may be provided with three shelves above the patient. The substantial portion of such a framework is illustrated in FIG. 10, wherein the far leg that would be mounted to the offside of the stretcher is left out for simplicity. In this embodiment, paired legs 134 have substantial horizontal portions 136 and substantial vertical portions 138 at their upper ends. A unified dual leg 130 has an integral horizontal crosspiece 132 connected at junctions 162 to legs 166. Vertical elements 140 are attached at end points 160 to horizontal portions 136 of legs 134 and are also attached at their upper ends at junctions 158 to a generally rectangular topmost tubular rack or frame 148. This rack 148 has a transverse element 146 attached at junctions 156 to the upward portions 138 of legs 134. Longitudinal bracing elements 150 may be provided to rack 148 for additional strength. A horizontal crosspiece 142 is attached at junctions 164 between legs 134 at the beginning of the horizontal portions 136 thereof. Longitudinal bracing elements 144 are connected between horizontal element 142 and the horizontal segment 132 to thereby define an intermediate shelf.

The lowermost generally rectangular rack 152 is attached at attachment points 166 to legs 134 and may be provided with longitudinal bracing elements 154 as illustrated in FIG. 10. Basically, other than the fact that three shelves are provided for instead of two, the basic principle of this embodiment is exactly the same as that of the preferred embodiments discussed at length hereinabove. Such a structure may be found advantageous for use with stretchers are used in ambulances having a sufficiently high vertical clearance. Also, this particular embodiment may be highly beneficial for use on mobile stretchers, i.e., those provided with casters, with or without brake elements, for use in or around operating rooms and trauma centers where the basic stretcher does not have to loaded onto or off of an ambulance. Such a stretcher may be rolled along ramps, sidewalks and uneven structural areas from one segment of the medical facility to another, with the critical care equipment accompanying the patient. In fact, each of the embodiments discussed herein provides advantages in use whether or not the stretcher is utilized with an ambulance.

Persons skilled in the art will immediately appreciate that there are numerous manufacturing facilities capable of cutting, bending and welding tubular structures of the type described herein. It follows that the basic structure is relatively light, simple and economical to make, and very versatile in that it lends itself to attachment to a standard ambulance type stretcher with commonly available standard fittings. The advantage of this invention can therefore be realized for existing stretchers at relatively low expense.

Persons skilled in the mechanical arts will also appreciate that the provision of leg 78, while not absolutely essential in terms of the strength of the tubular structure of the preferred embodiment of FIG. 1 encompassing only legs 60, 62, 64 and 66, adds significantly to the stability of the loaded framework and its ability to resist deflection when the stretcher is subjected to extraneous forces, e.g., when it is rolled over broken or uneven surfaces. Such persons will also appreciate, particular with reference to FIG. 8, that the slight inward orientation of legs 60 and 62 with respect to the longitudinal sides of tubular frame 48 of stretcher 20 will have the tendency of strengthening the entire structure and making it more rigid. Thus it would be unlikely that sensitive equipment mounted on the shelves 44 and 46 would suffer due to sudden extraneous forces acting on the loaded stretcher and the framework. The same considerations apply to the embodiment illustrated in FIG. 10.

It is anticipated that persons skilled in the art, armed with the knowledge provided by this disclosure, will contemplate a variety of modifications in the structure and uses of this invention. All such modifications and variations are expressly contemplated as being encompassed within the claims appended below.

What is claimed is:

1. Apparatus mountable to a standard collapsible ambulance-type stretcher by known fittings, for securely holding elements of critical care equipment in close proximity to or connected to a patient lying on the stretcher, during transportation of the stretcher on its own wheels or inside an ambulance, the system comprising:

a framework, comprising first and second pairs of support legs and one bracing leg, each of said support legs and bracing leg having a vertical portion with a lower end attachable by said known fittings to a portion of the stretcher and each having an inclined portion with an upper end attached to a first equipment support rack, said lower ends of said first and second pairs of support legs being positioned adjacent the normal location of the feet of the patient lying on the stretcher with the upper ends of each of said pairs of support legs being located forwardly thereof, with the lower end of said bracing leg being attached to said stretcher closest to the head of said patient and on that side of the stretcher that is opposite the side from which the patient is normally transferred to or from the stretcher.

2. The system according to claim 1, further comprising:

a second equipment support rack located between and supported solely by said first pair of support legs below said first support rack.

3. The system according to claim 1, wherein:

said first support rack comprises a flat first shelf thereon.

4. The system according to claim 3, wherein:

said first shelf is provided with first means for locating elements of said critical care equipment at predetermined positions thereon.

5. The system according to claim 4, wherein:

said first equipment locating means comprises apertures in said first shelf on said first support rack.

6. The system according to claim 3, further comprising:

first means for securely holding said elements of critical care equipment placed on said first shelf on said first rack.

7. The system according to claim 6, wherein:

said first equipment holding means comprises an adjustable belt.

8. The system according to claim 2, wherein:

said second support rack comprises a flat second shelf.

9. The system according to claim 8, wherein:

said second shelf is provided with second means for locating elements of said critical care equipment at predetermined locations thereon.

10. The system according to claim 9, wherein:

said second locating means comprises apertures in said second shelf.

11. The system according to claim 8, further comprising:

second means for securely holding said elements of critical care equipment placed on said second shelf on said second rack.

12. The system according to claim 11, wherein:

said second holding means comprises a belt.

13. The system according to claim 1, further comprising:

a flat lower shelf detachably supported by a portion of said stretcher below said patient.

14. The system according to claim 13, wherein:

said flat lower shelf is formed to have end portions of a partially cylindrical shape of a size for snap-fit engagement thereby of portions of said stretcher.

15. The system according to claim 14, wherein:

said flat lower shelf has an elongate aperture therein for easy grasping therethrough.

16. Apparatus mountable to a standard collapsible ambulance-type stretcher by known fittings, for securely holding elements of critical care equipment in close proximity to or connected to a patient lying on the stretcher, during transportation of the stretcher on its own wheels or inside an ambulance, the system comprising:

a framework, comprising first and second pairs of support legs and one bracing leg, each of said support legs and bracing leg having a vertical portion with a lower end attachable by said known fittings to a portion of the stretcher and each having an inclined portion with an upper end attached to a first equipment support rack, said lower ends of said first and second pairs of support legs being positioned adjacent the normal location of the feet of the patient lying on the stretcher with the upper ends of each of said pairs of support legs being located forwardly thereof, with the lower end of said bracing leg being attached to said stretcher closest to the head of said patient and on that side of the stretcher that is opposite the side from which the patient is normally transferred to or from the stretcher;

a second equipment support rack located between and supported solely by said first pair of support legs below said first support rack; and a third equipment support rack located above said first equipment support rack and supported thereon by a plurality of substantially vertical support elements.

17. The system according to claim 16, wherein:

said first support rack comprises a flat first shelf thereon, wherein said first shelf is provided with first means for locating elements of said critical care equipment at predetermined positions thereon and first means for securely holding said elements of critical care equipment placed on said first shelf on said first rack; and said second support rack comprises a flat second shelf, wherein said second shelf is provided with second means for locating elements of said critical care equipment at predetermined locations thereon and second means for securely holding said elements of critical care equipment placed on said second shelf on said second rack.

18. The system according to claim 17, further comprising:

a flat lower shelf detachably supported by a portion of said stretcher below said patient.

* * * * *